US005154218A

United States Patent [19]

Subecz

[11] Patent Number: 5,154,218

[45] Date of Patent: Oct. 13, 1992

[54] CURTAIN ROD AND RING COVER

[75] Inventor: Charles J. Subecz, New York, N.Y.

[73] Assignee: SRCO Incorporated, Westmont, Ill.

[21] Appl. No.: 702,618

[22] Filed: May 17, 1991

[51] Int. Cl.[5] ..... A47H 1/00

[52] U.S. Cl. ..... 160/330; 160/38

[58] Field of Search ..... 160/38, 39, 124, 330, 160/348, 341

[56] References Cited

U.S. PATENT DOCUMENTS

| | | | |
|---|---|---|---|
| 305,512 | 9/1884 | Courtright . | |
| 1,691,339 | 11/1928 | Deming . | |
| 1,828,012 | 10/1931 | Wragg . | |
| 1,856,752 | 5/1932 | Ellinger | 160/124 X |
| 1,939,617 | 12/1933 | Bernhard . | |
| 2,011,662 | 8/1935 | Thompson . | |
| 2,094,649 | 10/1937 | Gaines . | |
| 2.104,261 | 1/1938 | Landau . | |
| 2,301,161 | 11/1942 | Gaines . | |
| 2,316,337 | 4/1943 | Kenney . | |
| 2,323,444 | 7/1943 | Bixer | 160/124 |
| 2,417,623 | 3/1947 | Yellin . | |
| 2.587,492 | 2/1952 | Lipetz | 160/330 X |
| 2,600,152 | 6/1952 | Blatt | 160/124 |
| 2,652,586 | 9/1953 | Ramsberger | 160/330 X |
| 2,840,155 | 6/1958 | Stern | 160/124 |
| 2,859,810 | 11/1958 | Sachs | 160/124 |
| 2,989,191 | 6/1961 | Eason . | |
| 3,047,060 | 7/1962 | Heimberg | 160/330 |
| 3,115,181 | 12/1963 | Snyder | 160/330 X |
| 3,321,781 | 5/1967 | Reich . | |
| 4,058,241 | 11/1977 | Craig . | |
| 4,120,343 | 10/1978 | Wilson . | |
| 4,126,172 | 11/1978 | Faragher . | |
| 4,188,991 | 2/1980 | Boyle | 160/330 X |
| 4,333,187 | 6/1982 | Schuler | 160/330 X |
| 4,385,409 | 5/1983 | File et al. . | |
| 4,390,055 | 6/1983 | Fenley . | |
| 4,606,482 | 8/1986 | McHugh . | |

FOREIGN PATENT DOCUMENTS

| | | |
|---|---|---|
| 140330 | 12/1988 | Taiwan . |

*Primary Examiner*—David M. Purol

*Attorney, Agent, or Firm*—Thomas L. Secrest; Donald L. Rhoads

[57] ABSTRACT

A fabric cover is described for curtain rods and curtain rings. The fabric cover provides a valance or top treatment for a curtain and a pleasing effect to a room while suspending the curtain. Another embodiment provides a one piece curtain and curtain rod and ring cover.

16 Claims, 1 Drawing Sheet

CURTAIN ROD AND RING COVER

BACKGROUND OF THE INVENTION

This invention relates to a curtain valance or top treatment. Specifically, curtain rods and curtain rings are covered with fabric which provides a valance or top treatment for the curtain and a pleasing effect to a room. One application is to shower curtains.

Showers used for bathing generally consist of a spray head positioned at an elevated location within an enclosure capable of catching and draining water. In stall type and bathtub enclosures, it is common to use a horizontally traversable, flexible curtain that allows passage in and out of the shower enclosure. The curtain, when moved to its fully closed position, prevents water from escaping the enclosure. The curtain also provides privacy and a decorative effect, depending on the material used.

One important problem with maintaining a decorative look is where the shower curtain is suspended by curtain rings or hooks from a curtain rod. The curtain rings are generally made of plastic, metal or wood and do not create a pleasing appearance in so far as they are made of a material different from or uncomplementary to the fabric used for the shower curtain. The curtain rod also does not create a pleasing appearance when the curtain rod is made of a material different from or uncomplementary to the shower curtain. This same problem occurs with windows and other curtain applications using rods and rings.

While patents exist for making the curtain and the rings of the same material, such as for instance, Wilson, U.S. Pat. No. 4,120,343, as well as Thompson, U.S. Pat. No. 2,011,662, there is no specific teaching in any of these patents of coating or covering ordinary plastic, metal or wood curtain rings and curtain rods with a fabric that matches or complements the curtain to create a pleasing effect.

Valances, made of a short drapery, wood or metal frame, have long been used as a decorative heading to conceal the top of curtains. However, they require the expense and labor of adding a complicated structure to the walls or ceiling. It would be desirable to have a valance or top treatment that does not require the expense and labor of adding an additional structure. Moreover, it would be desirable to provide a valance or top treatment that installs with ease.

It is, accordingly, an object of the present invention to provide a fabric covering for curtain rods and rings.

It is another object of this invention to provide a fabric covering for curtain rods and rings which can match or complement the curtain and room.

It is another object of this invention to provide a fabric covering for curtain rods and rings which enables the curtain to be opened and closed.

It is still another object of this invention to provide a decorative curtain valance or top treatment that installs with ease and without the expense and labor of adding an additional structure.

These and other objects and advantages of the invention will be apparent from the following descriptions.

DESCRIPTION OF THE PREFERRED EMBODIMENTS

Figure 1:
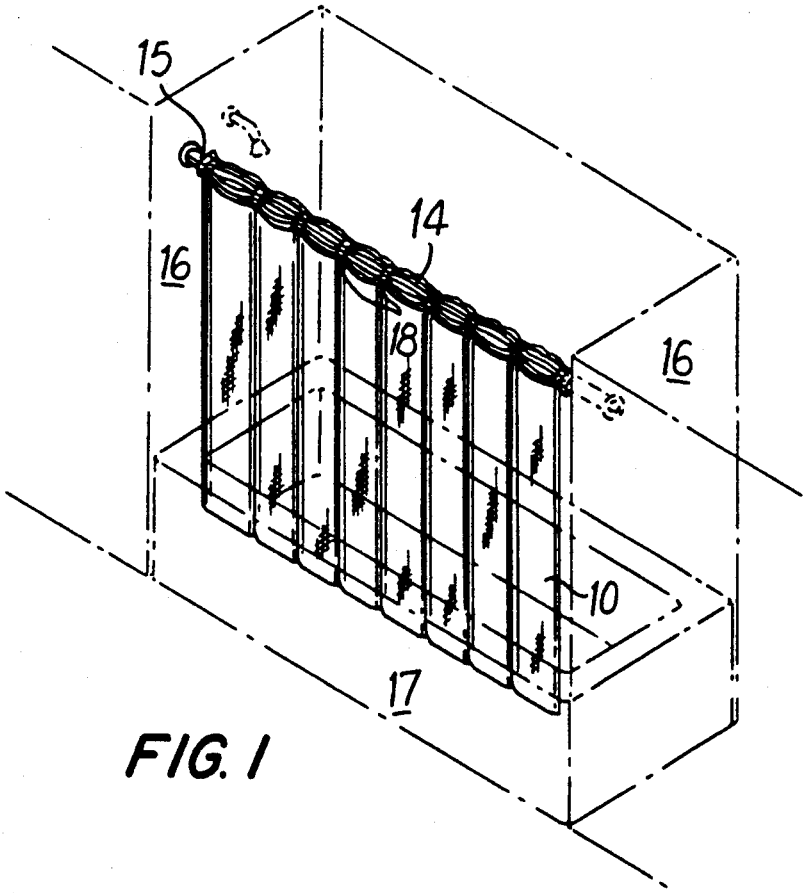
FIG. 1 is a perspective view of an embodiment of a curtain rod and ring cover of the present invention in a shower enclosure application with the shower curtain in its fully extended position on the shower curtain rod.

Referring to the drawings wherein like characters of reference indicate corresponding parts throughout, FIG. 1 is a suspended shower curtain 10 with the curtain rod and ring cover 14 of this invention. The curtain rod and ring cover 14 includes rings 12 that suspend the shower curtain 10 from the curtain rod 15 extending from the walls 16 which enclose a bathtub 17. The curtain rod and ring cover 14 creates a pleasing appearance in its extended position as shown in FIG. 1, since the cover creates a valance or top treatment for the shower curtain.

Figure 3:
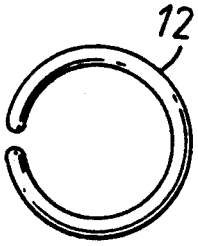
FIG. 3 is a side elevational view of a curtain ring.
Figure 4:
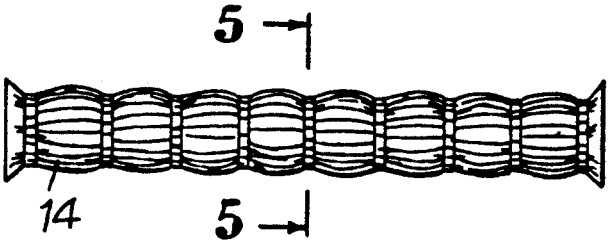
FIG. 4 is the curtain rod and ring cover of the present invention with the rings inserted.
Figure 5:
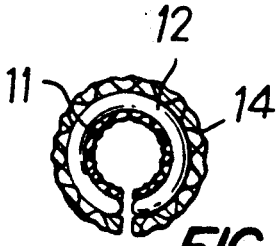
FIG. 5 is a sectional view of FIG. 4 taken on the line 5—5 and looking in the direction of the arrows.

As seen from FIG. 3, each of the rings 12 is substantially cylindrically shaped and bent into the form of a "C" with a cross section as shown in FIG. 5. The rings are sized to fit around the curtain rod 15 and through the apertures 18 that are disposed along the top of the curtain 10, as shown in FIG. 1.

Figure 2:
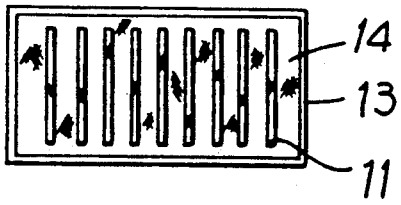
FIG. 2 is a plan view of the piece of material, with a hem and strips of fabric sewn on, that will form the curtain rod and ring cover when the rings are inserted.

The rings 12 are inserted into slots formed by sewing strips of fabric 11 onto the hemmed 13 curtain rod and ring cover 14, as shown in plan view in FIG. 2. The slots are created by only sewing the two longest sides of the strips of fabric 11 onto the curtain rod and ring cover 14. The insertion of the rings 12 into the slots gathers the fabric. When all the rings 12 are inserted, the curtain rod and ring cover 14 forms a tube, supported by the rings, which fits over the curtain rod 15. With the curtain rod and ring cover 14 over the curtain rod 15, the curtain 10 is then attached to the rings 12. A preferred embodiment of this invention includes adding another curtain or liner which also attaches to the rings. Functionally, this inner curtain or liner may serve to keep water in the shower enclosure. It may also provide more privacy, insulation, or a decorative effect in a shower or in some other application.

Since it is necessary to slide the curtain rod and ring cover 14 along the curtain rod 15 in order to open the curtain 10 to allow access to the shower, the rings 12 and the curtain rod and ring cover 14 must be sized to be slidably associated with the curtain rod 15.

When fully open (not shown) to allow entry into the shower, the fabric of the curtain rod and ring cover 14 pushes together to create a bunched, blossom look. This accordion-like effect allows the curtain to be fully operational; the curtain rod and ring cover does not impede the opening and closing of the curtain. When closed, FIG. 1, the curtain rod and ring cover 14 creates a valance or top treatment without adding additional structures to the walls or ceiling.

The curtain rod and ring cover 14 is installed with ease by slipping the cover over the curtain rod 15 and attaching the curtain 10 to the rings 12.

The curtain rod and ring cover 14 can also be made easy to care for by using water-impervious fabric and/or a mildew-resistant fabric. Some other material besides fabric may also be used.

It is noted that while the cross section of the rings 12 and the curtain rod and ring cover 14 are shown as being substantially circular, it should be realized that other cross-sections are contemplated as a part of this invention. This invention also contemplates the use of other types of rings, hooks, wires or other hanging elements for the curtain rings. Furthermore, the number of rings inserted into the curtain rod and ring cover as shown in the drawings is not meant to be limiting. This invention contemplates that any number of rings can be used.

Another preferred embodiment of this invention is where the shower curtain is not attached to the rings that are contained inside the curtain rod and ring cover but is instead attached to the fabric of the curtain rod and ring cover. The curtain may be either attached to the curtain rod and ring cover by means such as sewing or the curtain may be a continuation of the same piece of fabric that forms the curtain rod and ring cover.

The one piece design for the curtain and the curtain rod and ring cover eliminates the need for sewing button holes onto the curtain and providing support for the button holes that in the other embodiments are used for attachment to the rings. This eliminates much of the expense normally encountered with manufacturing curtains. The one piece curtain and curtain rod and ring cover is made precisely as described above for the curtain rod and ring cover. The only exception is that a larger piece of fabric is used. The same size slots are formed by sewing strips of fabric 11 onto the curtain rod and ring cover at the top of the larger piece of fabric.

In this one piece curtain and curtain rod and ring cover embodiment another curtain may be attached to the rings that are inside the curtain rod and ring cover part. This second curtain may serve to keep water in a shower enclosure or to provide privacy, insulation or a decorative effect to the shower or to some other application such as a window.

Accordingly, it will be understood that the invention is not to be limited to the specific construction or arrangement of parts shown. While a shower enclosure application is shown, this invention can also be applied in the same manner to windows and any other applications that utilize curtains, rods and rings. The parts may be widely modified within the invention as defined by the claims.

What is claimed is:

1. A valance for a curtain comprising a tubular-shaped fabric cover that completely covers a curtain rod and contains a plurality of slots through which curtain rings can be inserted so that the slots completely cover the curtain rings and the curtain rings suspend the curtain, said fabric cover forming and holding such tubular-shape due to the insertion of the curtain rings into the slots.

2. The valance of claim 1 wherein the curtain rings are "C" shaped and can be associated with the curtain rod by enlarging the opening of the "C" in order to slip the curtain rings over the curtain rod.

3. A decorative cover for a curtain rod comprising tubular-shaped fabric that completely covers the curtain rod and contains a plurality of slots through which curtain rings can be inserted so that the slots completely cover the curtain rings and the curtain rings suspend a curtain, said fabric forming and holding such tubular-shape due to the insertion of the curtain rings into the slots.

4. The decorative cover of claim 3 wherein the curtain rings are "C" shaped and can be associated with the curtain rod by enlarging the opening of the "C"in order to slip the curtain rings over the curtain rod.

5. A top treatment for a shower curtain comprising a tubular-shaped fabric cover that contains a plurality of curtain rings that suspend the shower curtain from a curtain rod, said fabric cover completely covering the curtain rod and completely covering the curtain rings, said fabric cover forming and holding such tubular-shape due to the insertion of the curtain rings into slots sewn into the fabric cover, and said fabric cover providing the shower curtain to be slidable and producing a pleasing effect.

6. The top treatment for a shower curtain of claim 5 wherein the curtain rings are "C" shaped and can be associated with the curtain rod by enlarging the opening of the "C" in order to slip the curtain rings over the curtain rod.

7. The top treatment for a shower curtain of either claim 5 or claim 6 wherein the fabric cover is of a material that is impervious to water.

8. The top treatment for a shower curtain of either claim 5 or claim 6 wherein the fabric cover is of a material that is mildew resistant.

9. A shower curtain and shower curtain rod and ring cover ensemble comprising a shower curtain suspended from a plurality of curtain rings, a tubular-shaped shower curtain rod and ring cover which contains a plurality of slots through which the curtain rings are inserted, said shower curtain rod and ring cover completely covers a curtain rod and completely covers the curtain rings and provides the shower curtain to be slidable and produces a valance and a decorative effect, said shower curtain rod and ring cover forming and holding such tubular-shape due to the insertion of the curtain rings into the slots.

10. The ensemble of claim 9 wherein a second curtain is attached to the curtain rings.

11. A curtain and a cover for a curtain rod and curtain rings comprising fabric that contains a plurality of slots through which a plurality of curtain rings are inserted so that the slots completely cover the curtain rings, said fabric providing a tubular-shaped cover for the curtain rod, said tubular-shape being formed and held due to the insertion of the curtain rings into the slots, said fabric completely covering the curtain rod, and said fabric also being of a length to provide the curtain.

12. The curtain and cover for a curtain rod and curtain rings of claim 11 wherein the curtain rings are "C" shaped and can be associated with the curtain rod by enlarging the opening of the "C" in order to slip the curtain rings over the curtain rod.

13. The curtain and cover for a curtain rod and curtain rings of either claim 11 or claim 12 wherein the fabric is impervious to water.

14. The curtain and cover for a curtain rod and curtain rings of either claim 11 or claim 12 wherein the fabric is mildew-resistant.

15. The curtain and cover for a curtain rod and curtain rings of either claim 11 or claim 12 wherein a second curtain is added by attachment to the curtain rings.

16. A fabric valance for a curtain comprising a flat piece of fabric, slots provided in the fabric to receive and completely cover curtain rings, wherein insertion of curtain rings in the slots imparts and maintains a tubular shape to the valance so that the valance will completely cover a curtain rod.

* * * * *